US009718649B2

(12) United States Patent
Swope

(10) Patent No.: US 9,718,649 B2
(45) Date of Patent: Aug. 1, 2017

(54) CLAMPING APPARATUS

(71) Applicant: Terry S. Swope, Sandy, UT (US)

(72) Inventor: Terry S. Swope, Sandy, UT (US)

( * ) Notice: Subject to any disclaimer, the term of this patent is extended or adjusted under 35 U.S.C. 154(b) by 0 days.

(21) Appl. No.: 15/069,816

(22) Filed: Mar. 14, 2016

(65) Prior Publication Data

US 2016/0264381 A1 Sep. 15, 2016

Related U.S. Application Data

(60) Provisional application No. 62/132,447, filed on Mar. 12, 2015.

(51) Int. Cl.

| | |
|---|---|
| ***B66C 1/64*** | (2006.01) |
| ***B66C 1/42*** | (2006.01) |
| ***B25B 5/10*** | (2006.01) |
| ***B25B 5/14*** | (2006.01) |

(52) U.S. Cl.

CPC ..... *B66C 1/422* (2013.01); *B25B 5/103* (2013.01); *B25B 5/14* (2013.01); *B25B 5/147* (2013.01); *B66C 1/64* (2013.01)

(58) Field of Classification Search

CPC .... B66C 1/28; B66C 1/44; B66C 1/64; B66C 1/422; B25B 5/08; B25B 11/02; B25B 13/38; B25B 5/103; B25B 5/14; B25B 5/147

USPC ..... 294/116, 117; 269/46, 90, 234

See application file for complete search history.

(56) References Cited

U.S. PATENT DOCUMENTS

| | | | | |
|---|---|---|---|---|
| 1,074,407 | A * | 9/1913 | Braden et al. | B61K 7/20 104/258 |
| 1,134,466 | A * | 4/1915 | Laframboise | B25J 15/0226 104/259 |
| 1,682,658 | A | 8/1928 | Bosco et al. | |
| 1,814,107 | A | 7/1931 | Zavatkay et al. | |
| 1,866,484 | A | 7/1932 | Priem et al. | |
| 1,972,583 | A | 9/1934 | Cullen et al. | |
| 2,324,361 | A | 7/1943 | Chandler et al. | |
| 2,675,201 | A | 4/1954 | Friel et al. | |
| 2,765,139 | A | 10/1956 | White et al. | |
| 2,916,244 | A * | 12/1959 | Renfroe | B66C 1/64 105/154 |
| 3,084,893 | A | 4/1963 | Ruth et al. | |

(Continued)

FOREIGN PATENT DOCUMENTS

WO WO2005124042 A1 12/2005

*Primary Examiner* — Dean Kramer

(74) *Attorney, Agent, or Firm* — Morriss O'Bryant Compagni, PC

(57) ABSTRACT

A lifting and support device comprises a first yoke having a first support arm that defining a first wedge slot above the first support arm and a second yoke pivotally coupled to the first yoke having a second support arm inwardly extending toward and laterally spaced from the first support arm and defining a second wedge slot above the second support arm. The first and second wedge slots are substantially aligned when the first and second yokes are in a closed position. A wedge is configured for insertion within the first and second wedge slots when the first and second wedge slots are substantially aligned to hold a structure between the wedge and the first and second support arms of the first and second yokes in order to support a structure relative to the lifting and support device.

20 Claims, 12 Drawing Sheets

(56) References Cited

U.S. PATENT DOCUMENTS

| | | | | | |
|---|---|---|---|---|---|
| 3,201,167 | A | * | 8/1965 | Wampler | B66C 1/64 294/106 |
| 3,572,808 | A | * | 3/1971 | Miller | B66C 1/64 294/118 |
| 3,632,152 | A | * | 1/1972 | Renfroe | B66C 1/64 248/228.4 |
| 4,195,873 | A | * | 4/1980 | Johnston | B66C 1/64 294/106 |
| 4,281,868 | A | * | 8/1981 | Lovitt | E01B 29/16 104/307 |
| 4,475,726 | A | * | 10/1984 | Smith | B23K 37/0408 228/49.1 |
| 4,541,155 | A | | 9/1985 | Gagnon | |
| 5,468,035 | A | | 11/1995 | Fountain | |
| 5,730,432 | A | * | 3/1998 | Gendreau | E04G 17/045 269/217 |
| 6,244,581 | B1 | | 6/2001 | Arnhold | |
| 6,325,581 | B1 | | 12/2001 | Abell | |
| 8,770,885 | B2 | | 7/2014 | Myers | |
| 2014/0270920 | A1 | | 9/2014 | Bacon | |

* cited by examiner

CLAMPING APPARATUS

CROSS-REFERENCE TO RELATED APPLICATION

This application claims priority to U.S. Patent Application Ser. No. 62/132,447, filed on Mar. 12, 2015, the entirety of which is incorporated by this reference.

BACKGROUND

Field of the Invention

The present invention relates generally to devices for supporting steel beams during construction of a steel framed building, and, more specifically, to an apparatus for supporting a beam, pipe or other structure relative to another during a connection operation by maintaining one beam or structure relative to the other beam or structure until the two beams or structures are properly secured.

State of the Related Art

The assembly of steel beams in the construction of a steel framed building, bridge or other structure requires proper alignment of various beams, including I-beams, T-beams and other similar beams relative to one another until the beams are properly bolted, riveted or welded together. Each beam, depending on the size and length of the beam can weigh several hundred pounds. When the beams are being assembled, they are often lifted by a crane and guided by hand into position until attachment to another beam is completed.

Typical beams include various I-beams, such as wide flange beams, American standard beams, joists, standard mill beams and junior beams. Other types of steel beams include column beams, channels, angle beams, T-beams and Z-beams, to name a few. In beam-to-beam connections, such as the beam-to-beam connection shown in FIG. 1, a support beam 1 and a cross-beam 2 are attached with bolts 3. The cross-beam 2 includes an attachment flange 4 at its distal end that protrudes from the upper and lower flanges 5 and 6 of the cross-beam 2 a distance to fit against the web 7 of the support beam 1. The attachment flange 4 includes a pattern of holes for attachment to a similarly configured pattern of holes (not visible) in the web 7 of the support beam 1. The bolts 3 extend through the holes in the attachment flange and through the holes in the support beam 1 and are secured with nuts on the opposite side of the support beam 1. When attached, the top surface of the cross-beam 2 is aligned and substantially level with the top surface of the support beam.

For this type of beam-to-beam connection, the cross-beam must be carefully aligned relative to the main beam until the holes used to bolt the two beams together are properly aligned. This procedure most often requires hoisting the beam being coupled to the main beam by a crane while workers attempt to align the bolt holes. Because of the substantial mass these steel beams, the process of aligning the two beams can be quite dangerous. That is, as the two beams are brought together in close proximity, various pinch points are created. These pinch points, in which the arms, hands and fingers of a worker can rather easily get injured by being caught between the two beams, can result in significant injury including amputation as the beams are being aligned.

Thus, there is a significant need in the art to provide a device that assists workers in supporting and securing one beam relative to another during a beam-to-beam attachment operation.

SUMMARY OF THE INVENTION

Accordingly, the present invention provides a clamping apparatus comprising a first yoke having a first inwardly extending beam support arm and defining a first wedge slot above the first support arm. A second yoke is pivotally coupled to the first yoke and has a second inwardly extending support arm laterally spaced from the first support arm. The second yoke defines a second wedge slot above the second support arm. The first and second wedge slots are substantially aligned when the first and second yokes are in a first closed position. A wedge is configured for insertion within the first and second wedge slots when the first and second wedge slots are substantially aligned to hold a structure between the wedge and the first and second support arms of the first and second yokes.

These and other aspects of the present invention may be realized in an improved clamping apparatus as shown and described in the following figures and related description.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings.

Figure 1:
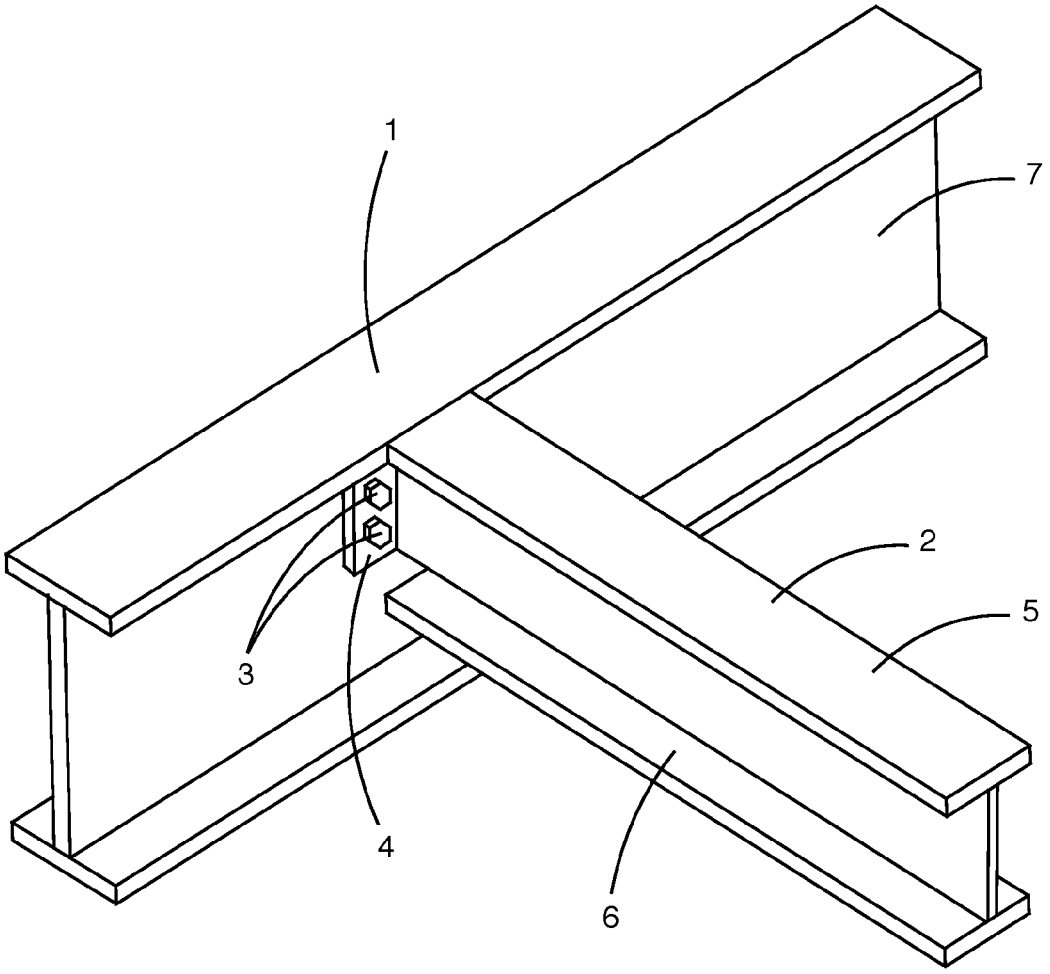
FIG. 1 (PRIOR ART)
FIG. 1 is a prior art beam-to-beam connection.

It will be appreciated that the drawings are illustrative and not limiting of the scope of the invention, which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. Elements and acts in the figures are illustrated for simplicity and have not necessarily been rendered according to any particular sequence or embodiment.

DETAILED DESCRIPTION OF THE ILLUSTRATED EMBODIMENTS

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶ 6. Thus, the use of the words "function," "means" or "step" in the Detailed Description of the Invention or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. Thus, the full scope of the inventions is not limited to the examples that are described below.

Figure 2:
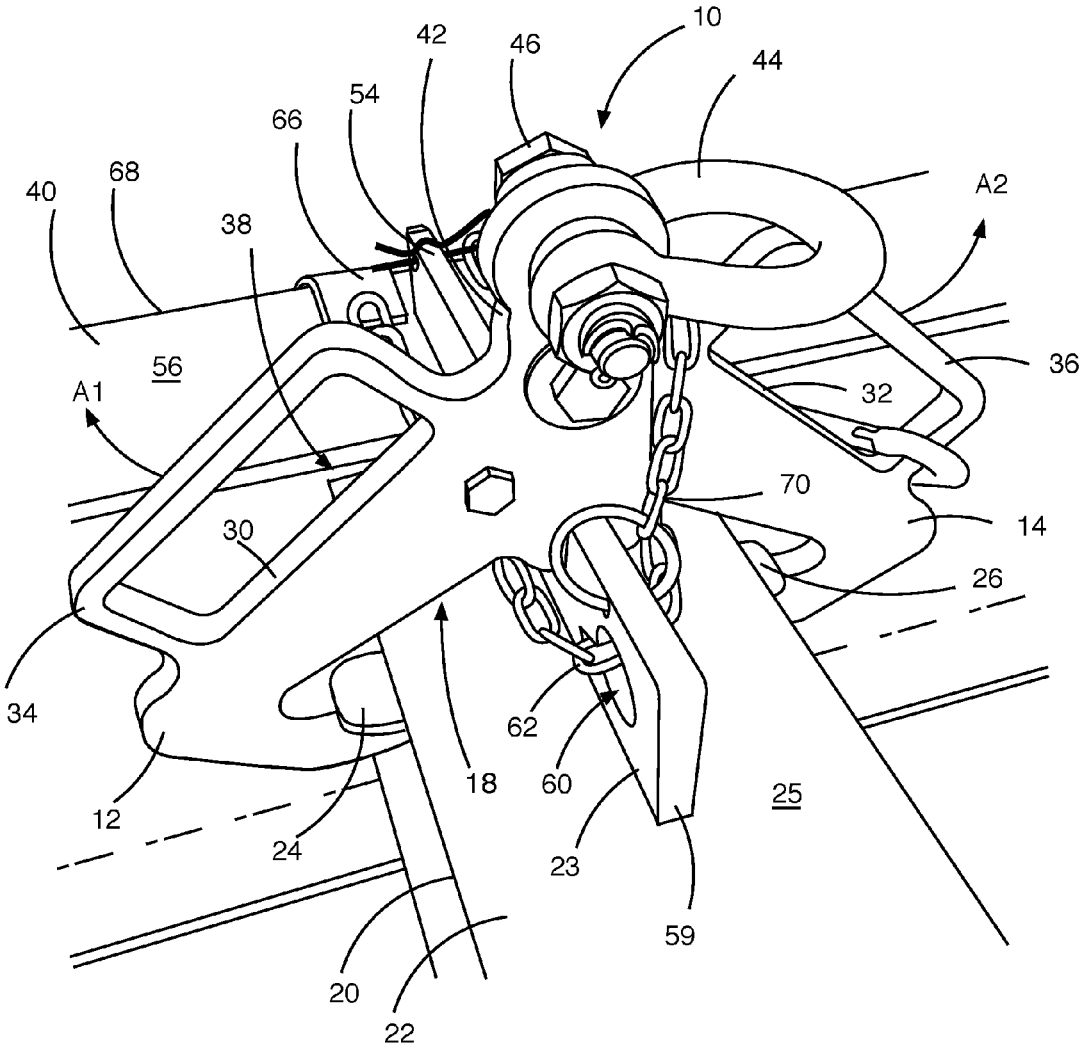
FIG. 2 is a perspective front view of a first embodiment of an apparatus for supporting a beam in accordance with the principles of the present invention.
Figure 3:
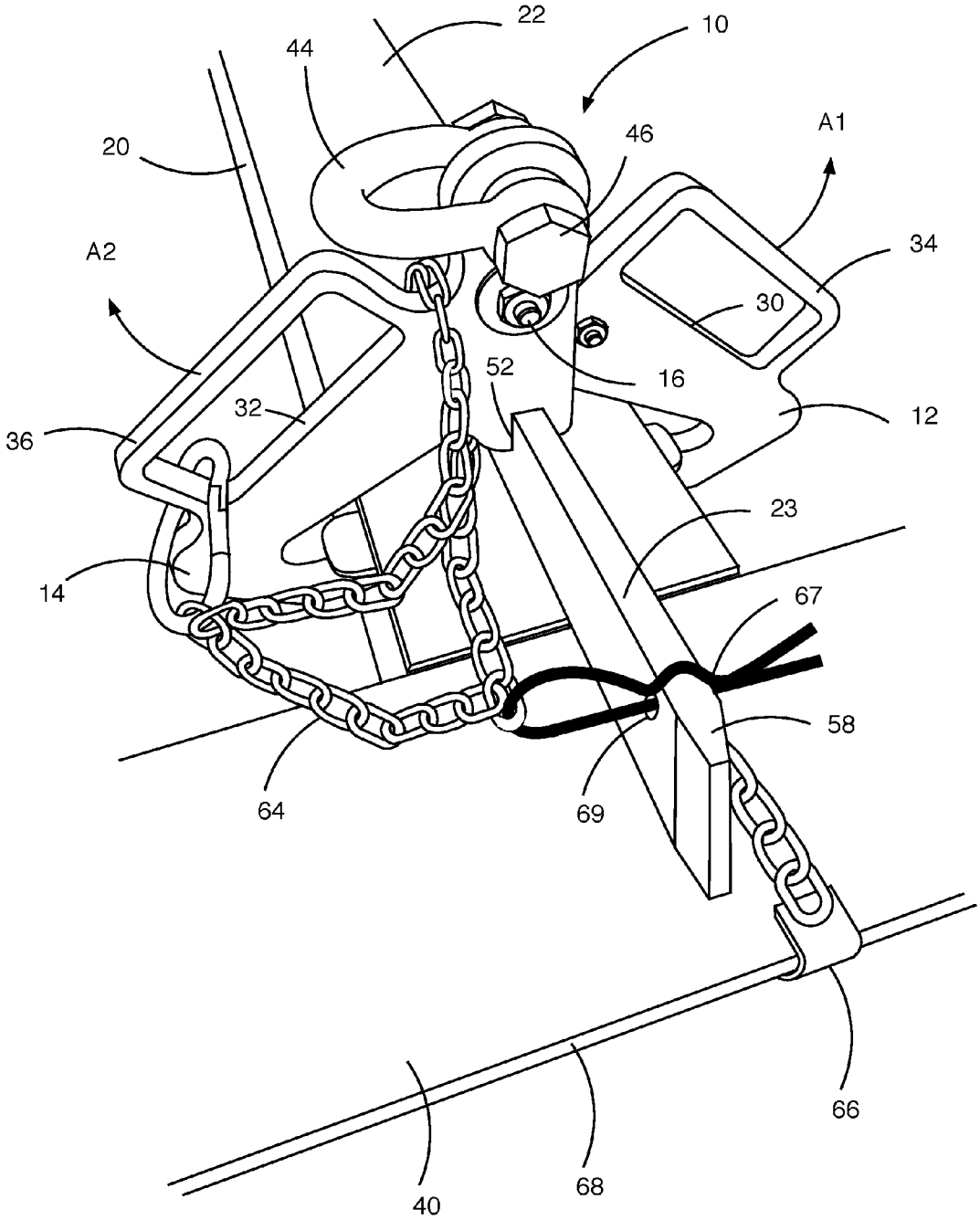
FIG. 3 is a perspective back view of the apparatus for supporting a beam illustrated in FIG. 2.

FIGS. 2 and 3 illustrate a clamping apparatus, generally indicated at 10, in accordance with the principles of the present invention. The clamping apparatus 10 is comprised of two opposing yoke structures 12 and 14, pivotally coupled to one another around bolt 16. The yoke structures 12 and 14, define a beam opening 18 within which a top flange 20 of a beam 22 can be positioned. The beam opening 18 has a generally triangular or trapezoidal shape to accommodate the top flange 20 of the beam 22 and to accommodate the wedge 23 between the yoke structures 12 and 14 and the top surface 25 of the beam 22. Each yoke structure 12 and 14 includes inwardly extending beam support pads 24 and 26, respectively, that can be integrally formed portions of the respective yoke structures 12 and 14, or separate plate members that are welded or otherwise attached to the respective yoke structure 12 and 14. When the clamping apparatus 10 is in a closed position as shown in FIGS. 2 and 3, the pads 24 and 26 are laterally spaced from one another so as to be able to reside under the top flange 20 of the beam 22, with the spacing being such that side-to-side movement of the beam 22 relative to the clamping apparatus 10 cannot dislodge the beam from the clamping apparatus.

The each upper side 30 and 32 of each yoke structure 12 and 14 includes a handle 34 and 36, respectively. The handles 34 and 36 are positioned on the upper sides 30 and 32 of the yoke structures 12 and 14, respectively, so that the clamping apparatus 10 can be moved or adjusted with the handles relative to the beam 22 when the apparatus is not attached to the beam, and then to maneuver the beam 22 using the handles once the apparatus 10 is attached, without the need to place the hands of the worker near any possible pinch point 38 between the beam 22 and the support beam 40. The upper end 42 of the yoke structure 12 also includes a lifting ring 44 pivotally attached thereto with a bolt 46 or other fastener known in the art. The lifting ring 44 can be used to "tie-off" the clamping apparatus 10 during use so that if the clamping apparatus 10 is accidentally dropped when it is being moved into position, it cannot fall and injure another worker below. In addition, in some operations, the lifting ring 44 can be used to attach to a crane or other hoisting device to lift or support a beam to which the clamping apparatus 10 is attached.

In order to attach the clamping apparatus 10 of the present invention to a cross-beam 22 and to the main support beam 40, the yoke structures 12 and 14 are pivoted open as shown by arrows A1 and A2. This can easily be accomplished by pulling the handles 34 and 36 apart when the wedge member 23 is not inserted between the yoke structures 34 and 36 as shown in FIGS. 2 and 3. When the yoke structures 12 and 14 are in an open position, the pads 24 and 26 are separated enough to allow the clamping apparatus 10 to be placed around the upper flange 20 of the beam 22. The yoke structures 12 and 14 can then be pivoted about the bolt 16 until the slots, slot 52 being visible, are approximately aligned for receiving the wedge 23. The yoke structures 12 and 14 are positioned proximate the end of the beam 22 so that when the wedge 23 is fully inserted between the yoke structures 12 and 14, a distal end portion 54 of the wedge 23 extends over a top surface 56 of the support beam 40 a sufficient amount, e.g., 3 to 5 inches. Once the wedge 23 has been inserted between the yoke structures 12 and 14 and properly extends over the support beam 40, the proximal end 56 of the wedge 23 is struck with a hammer to force the pads 24 and 26 into tight engagement with the underside of the flange 20 of the beam 22. The forcing of the wedge 23 between the yoke structures 12 and 14, tightly secures the clamping apparatus 10 to the beam 22.

The wedge 23 defines a locking aperture 60 that extends transversely through the wedge 23. The locking aperture 60 is configured to receive a link 62 of a chain 64 to secure the chain 64 to the wedge 23. The chain 64 is coupled to a hook member 66 configured to wrap around a distal edge 68 of the beam 40. The chain 64 then extends from the hook member 66 to the locking aperture 60 to hold the wedge 23 and thus the beam 22 relative to the beam 40. That is, once the chain 64 is arranged as shown in FIG. 2, the beam 22 cannot swing away from the beam 40. As further shown in FIG. 3, the chain 64 then extends to a hairpin cotter pin 67 (or bridge pin), that is secured to a hole 69 in the distal end 58 of the wedge 23. The opposite end 70 of the chain 64 is then secured to the handle 36 of the yoke 14 with a securing device, such as a carabineer. The intermediate securing point of the chain 64 to the distal end 58 of the wedge 23 holds the link 62 within the locking aperture 60. Thus, in order to dislodge the wedge 23 from the yokes 12 and 14, the pin 67 must be removed so that the chain can be pulled through the aperture 60 a sufficient amount to allow removal of the hook member 66 from the edge 68 of the beam 40. As shown in FIG. 2, the distal end 70 is attached to the proximal end 56 of the wedge 23. Thus, with the chain 64 secured to the handle 36 and to the wedge 23, even when the chain is not connected to the aperture 60, the wedge 23 is secured to the handle 36 with the chain 64 to prevent the wedge 23 from being inadvertently dropped onto others below.

The cantilevered end 54 of wedge 23 extends over the support beam 40 and thus fully supports the weight of the end of the beam 22 to which the clamping apparatus 10 is attached. The end portion 54 of the wedge 23 rests upon the top surface 56 of the beam 40. Because the bottom surface of the wedge 23 is planar and aligned with the top surface 25 of the beam 22, the bottom surface of the wedge 23 also aligns the top surface 25 of the beam 22 with the top surface 56 of the beam 40. Thus, the worker only needs to slide the wedge 23 along the top surface 56 of the beam 40 until the holes in the beam 22 horizontally align with the holes in the support beam 40.

Figure 4:
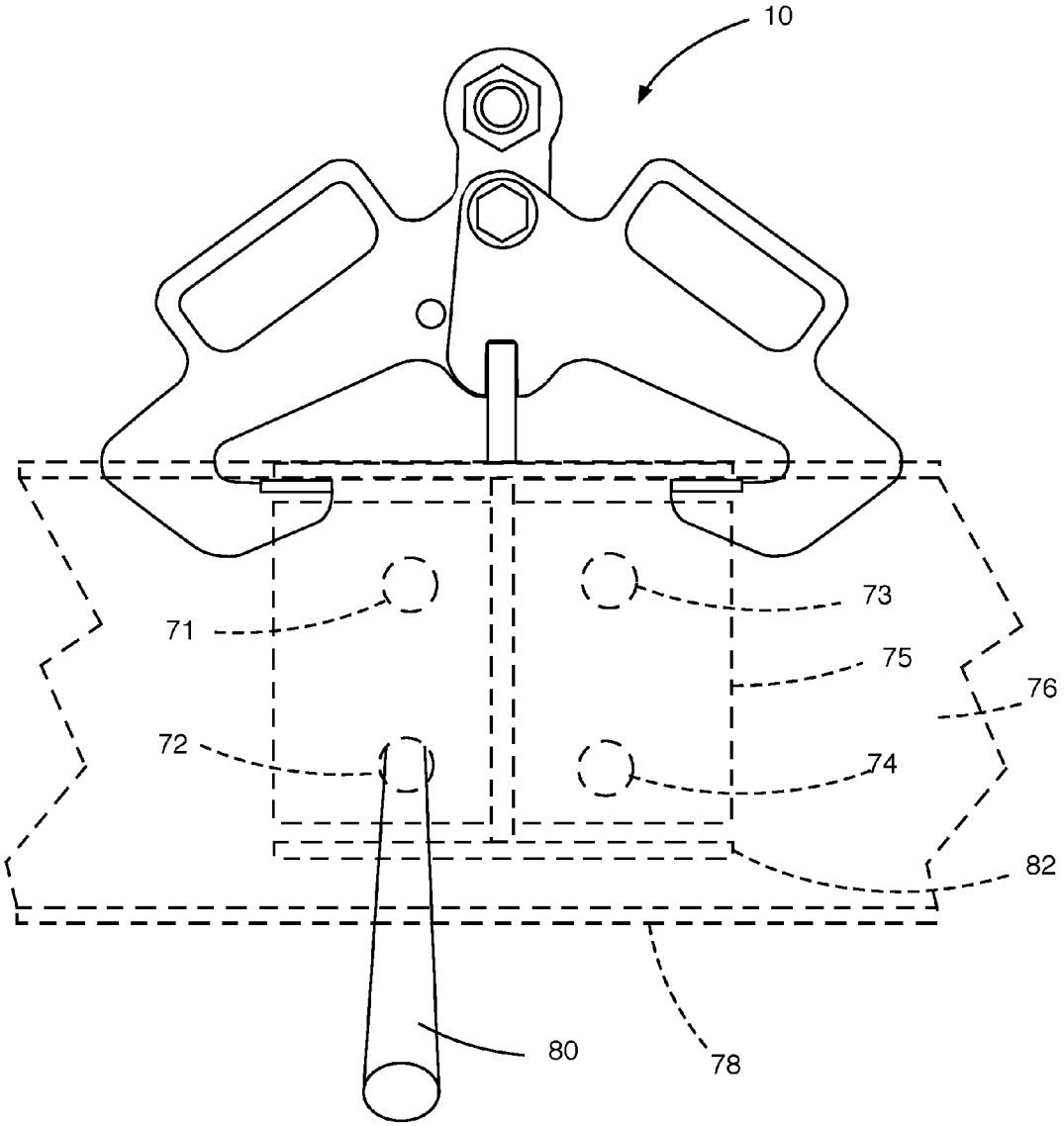
FIG. 4 is a front side view of the apparatus in accordance with the principles of the present invention while making a beam-to-beam connection.
Figure 5:
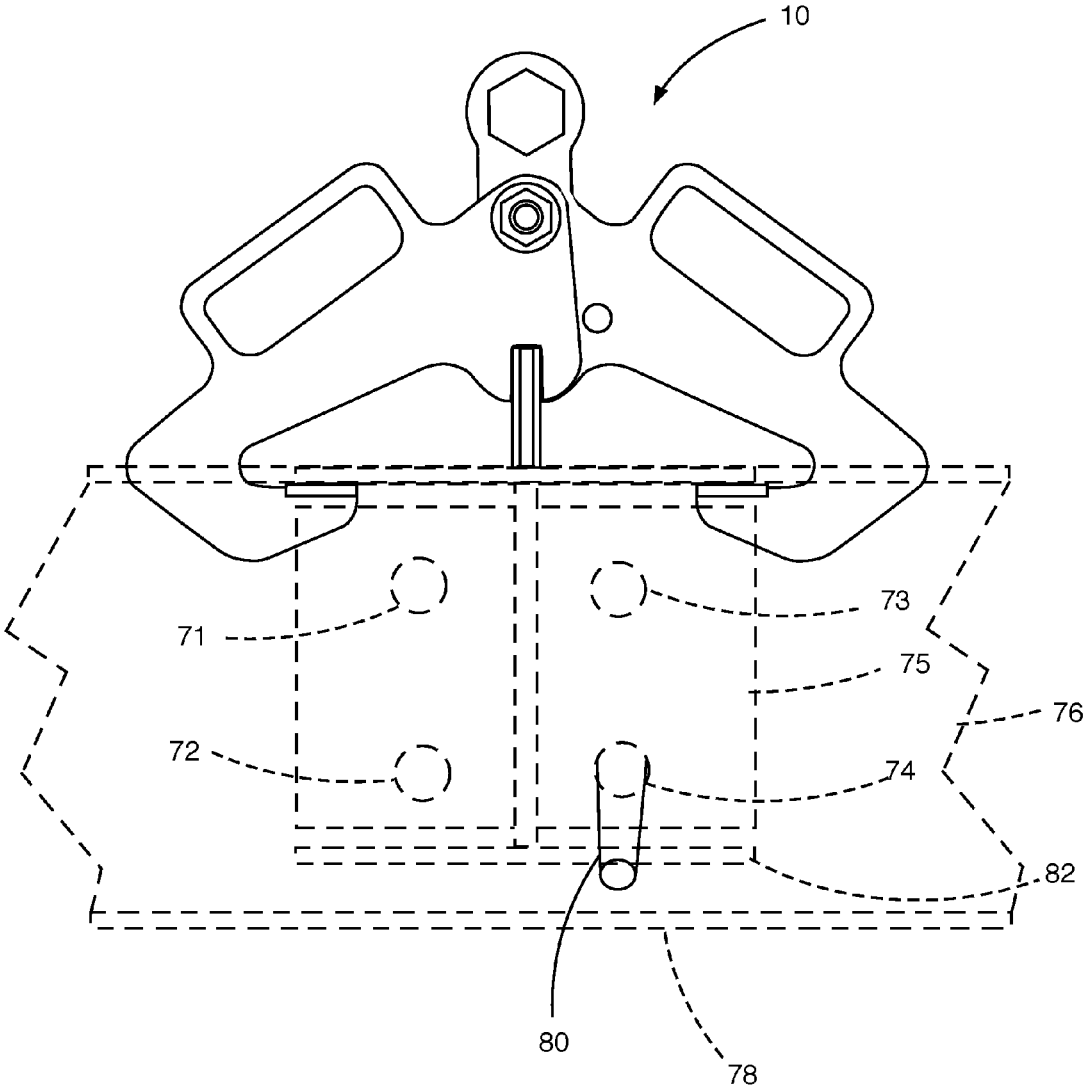
FIG. 5 is a back side view of the apparatus shown in FIG. 4 while making the beam-to-beam connection.

As shown in FIGS. 4 and 5, once a beam support device 10 according to the principles of the present invention is attached to and between two beams 78 and 82 to be secured together, the holes 71-74 in the attachment flange 75 must be properly aligned with corresponding holes 71'-74' in the web 76 of the beam 78. In order to align the holes 71-74 in the attachment flange 75 with the corresponding holes in the web 76 of the beam 78, a tapered steel rod 80 is inserted through one of the holes 71-74 in the attachment flange 75 and through a corresponding hole in the web 76 of the beam 78. Because the rod 80 is tapered, as the rod 80 is further inserted, the holes in the flange and web are quickly aligned so that attachment bolts can be inserted in the other three holes. Thus, once the respective holes are closely aligned, insertion of the steel rod 80 holds the horizontal position of the two beams 78 and 82 in position until the securing bolts (not illustrated) can be inserted through the holes and tightened with corresponding nuts in order to mount the beam 82 to the support beam 78.

Figure 6:
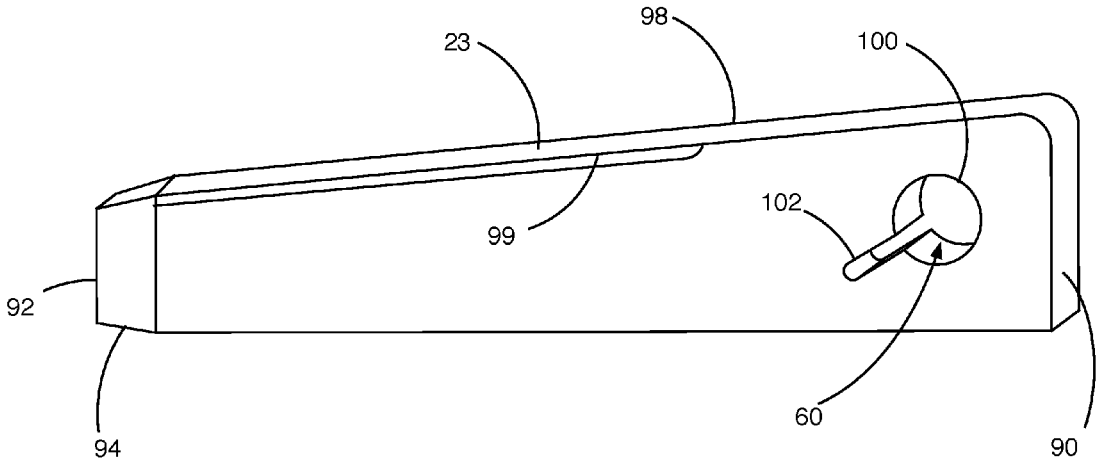
FIG. 6 is a perspective side view of a wedge in accordance with the principles of the present invention.

Referring now to FIG. 6, the wedge 23 according to the principles of the present invention is illustrated. The wedge 23 is comprised on an elongate tapered metal plate having a width slightly smaller than a width of the notches, previously described in the first and second yokes. The wedge 23 is tapered from a first end 90 to a second end 92 such that the first end 90 has a height greater than a height of the second end 92. The second end 90 further includes an inwardly tapered nose portion 94 that includes tapers in width and height of the wedge 23. The nose portion 94 is tapered to provide ease of initial insertion within the notches of the yokes. The top edges 98 and 99 of the wedge 23 may be chamfered for further ease of insertion and later release of the wedge from the yokes. The wedge 23 has a length such that when the wedge 23 is fully inserted into the yokes (as shown in FIGS. 2 and 3), the end 92 of the wedge 23 extends sufficiently over a support beam so that the other beam is properly and fully supported by the wedge 23.

The locking aperture 60 is defined by a first circular portion 100 having a diameter sufficient to allow free passage of the chain there through. A locking channel 102 in communication with a side of the first circular portion 100 extends at a downward angle and toward the end 92 of the wedge. The locking channel 102 is sized to receive a link of the chain. That is, the locking channel has a width that is slightly larger than a diameter of the metal forming a link. When a link is inserted in a sideways manner into the locking channel, adjacent links will abut against the sides of the wedge 23 adjacent the locking channel such that the chain cannot be pulled in either direction through the aperture 60 more than the approximately length of the link positioned within the locking channel 102. Thus, once the chain is pulled through the aperture 60 and a link is inserted into the locking channel 102, the chain will remain in this position until the link is lifted from the locking channel 102. The wedge 23 is formed from steel and has a width sufficient to support the weight of the beam attached to the clamping apparatus of the present invention. For example, the wedge 23 as well as the yoke structures previously described may be formed from ½ inch steel plate.

Figure 7:
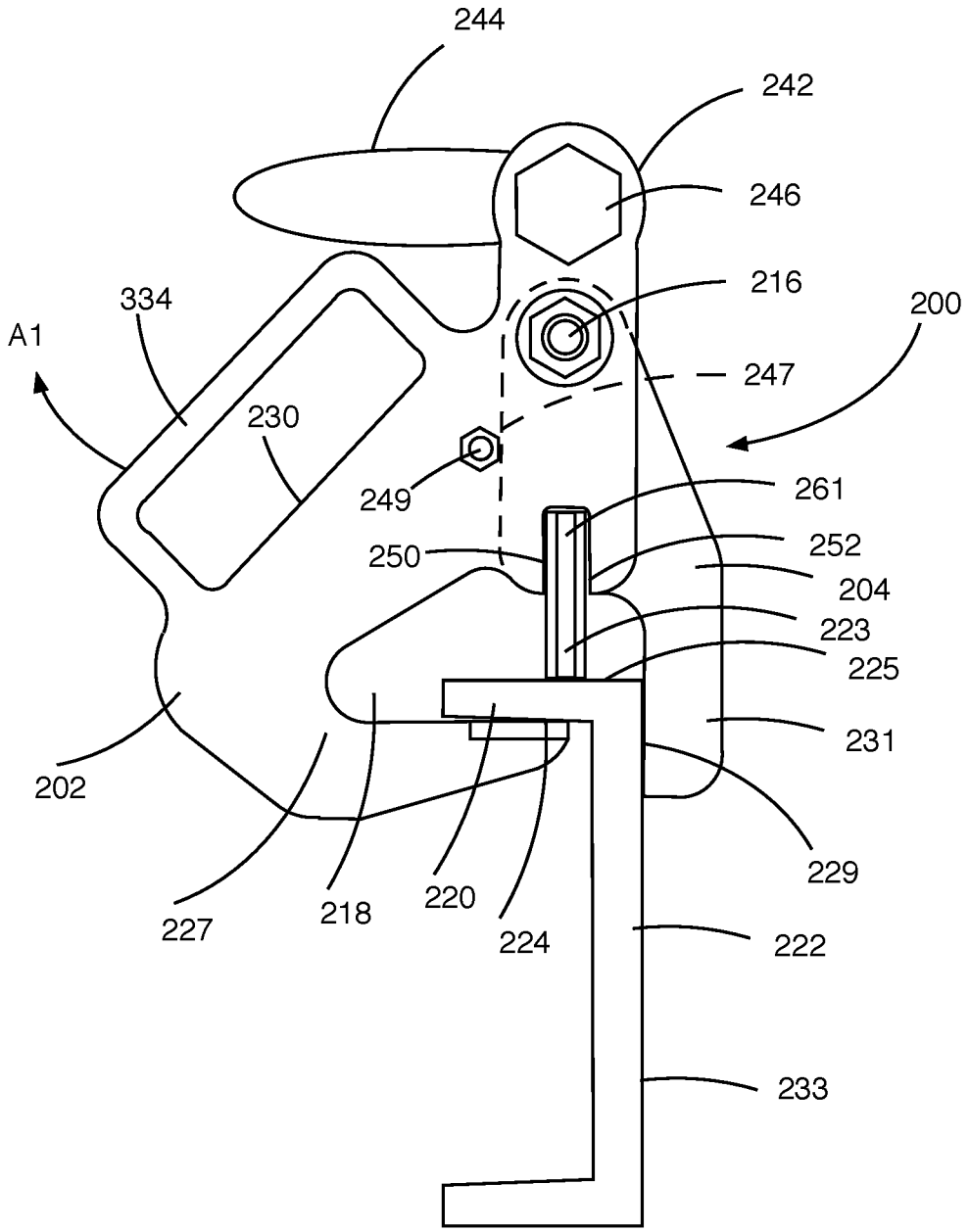
FIG. 7 is a front view of a second embodiment of an apparatus for supporting a structure in accordance with the principles of the present invention.

Referring now to FIG. 7, there is illustrated an alternative embodiment of a beam support and or lifting apparatus, generally indicated at 200, in accordance with the principles of the present invention. The apparatus 200 is comprised of a yoke 202 and a side brace 204. The yoke 202 and brace 204 are pivotally coupled together around bolt 216. The yoke 202 and brace 204 define a beam opening 218 within which one flange 220 of a beam 222 can be positioned. The beam opening 218 may be generally of any shape so long as it can accommodate a flange 220 of the beam 222 and the wedge 223 between the yoke 202 and the surface 225 of the beam 222. The yoke 202 includes inwardly extending beam support pad 224 that can be an integrally formed part of the yoke 202, or a separate plate that is welded or otherwise attached to the arm portion 227 of the yoke 202. When the apparatus 200 is in a closed position as shown in FIG. 7, the pad 224 is laterally spaced from the inside surface 229 of the side brace 204 so that the pad 224 resides under the flange 220 of the beam 222 and the arm 231 of the side brace 204 extends along a side surface 233 of the beam 222. As such, side-to-side movement of the beam 222 relative to the apparatus 200 is restricted and the beam 222 cannot be dislodged from apparatus 200.

Similar to previously described embodiments, the upper side 230 of the yoke 202 includes a handle 334. The handle 334 is positioned on the upper side 230 of the yoke structure 202 so that the apparatus 200 can be moved or adjusted relative to the beam 222 prior to securing the apparatus 200 to the beam, and then to maneuver the beam 222 once the apparatus 200 is attached, without the need to place the hands of the worker near any possible pinch points between the beam 222 and any other beam or structure. The upper end 242 of the yoke 202 also includes a lifting ring 244 pivotally attached thereto with a bolt 246 or other fastener known in the art. The lifting ring 244 can be used to "tie-off" the apparatus 200 during use so that if the clamping apparatus 200 is accidentally dropped when it is being moved into position, it cannot fall and injure another worker below. In addition, in some operations, the lifting ring 44 can be used to attach to a crane or other hoisting device to lift or support the beam 222 to which the apparatus 200 is attached.

In order to attach the clamping apparatus 200 of the present invention to the beam 222, the yoke 202 is pivoted open as shown by arrow A1 relative to the brace 204. This can easily be accomplished by lifting the handle 334 while pulling the arm 231 of the side brace 204 when the wedge member 223 is not inserted in the wedge notches 250 and 252 of the yoke 202 and side brace 204, respectively. When the yoke 202 and side brace 204 are in an open position, the pad 224 is separated enough from the inside surface 229 of the side brace 204 to allow the apparatus 200 to be placed around the flange 220 of the beam 222. The yoke 202 and side brace 204 can then be pivoted about the bolt 216 until the slots 250 and 252 are approximately aligned for receiving the wedge 223. The bolt 249 inserted through the yoke 202 provides an abutment for the side 247 of the side brace 204 so that when the yoke 202 and side brace 204 are pivoted to a closed position as shown, the bolt 249 provides a physical abutment structure or stop to stop inward rotation of the side brace 204 relative to the yoke 204 at a point where the two wedge notches or slots 250 and 252 are substantially aligned.

When one apparatus 200 is used to lift a beam 222, the apparatus is installed on the beam 222 with the yoke 202 and side brace 204 positioned proximate a center of the beam so that the beam is substantially balanced. Likewise, two such devices 200 can be used, one near each end to lift the beam 222. Once the wedge 223 has been fully inserted into the wedge slots 250 and 252, the back end of the wedge 223 is struck with a hammer to force the wedge into the slots 250 and 252 to force the wedge 223 into tight engagement with the to surface of the beam and the pad 224 into tight engagement with an underside of the flange 220 of the beam 222. To remove the apparatus 200, the front end 261 of the wedge 223 is struck with a hammer to force the wedge 223 from engagement with the beam 222 and the wedge slots 250 and 252, The wedge 223 may be configured as previously described with reference to other embodiments herein by including a locking aperture and associated chain for locking the wedge to the beam and securing the wedge 223 to the device 200 to prevent the wedge from being dropped.

Figure 8:
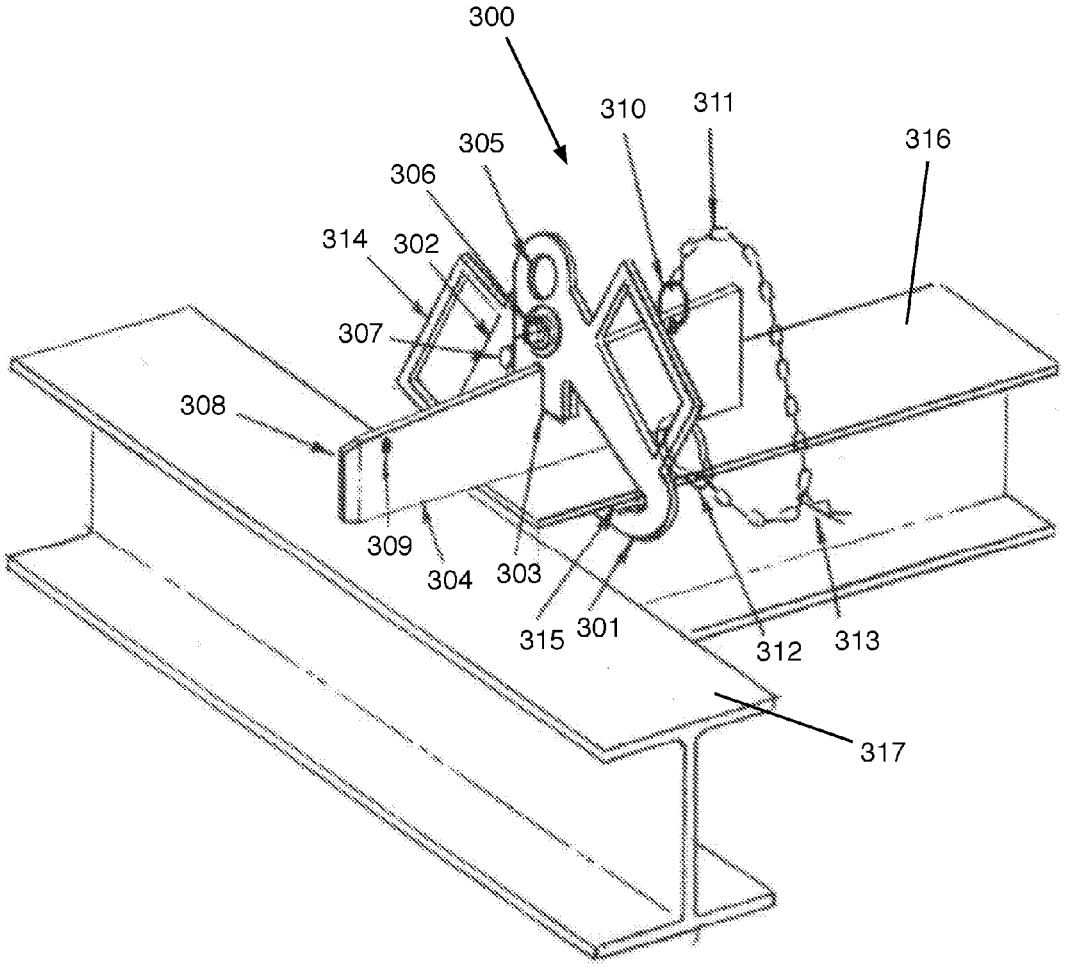
FIG. 8 is a perspective back side view of yet another embodiment of a beam support apparatus of the present invention.

In FIG. 8 illustrates another embodiment of a clamping device according to the present invention. The clamping device includes a left hand yoke plate 301, a right hand yoke plate 302, an alignment slot 303 for receiving the wedge plate 304 between the left and right yoke plates 301 and 302, respectively. A hole 305 for a shackle attachment, such as a ½ inch diameter hole, is provided in the top of the wedge plate 301. A hex bolt pivot pin 306 is provided with a locking nut, such as a Nylok nut. A stop pin 307 is provided in the right yoke plate 302. The tapered end 308 of the wedge plate 304 is provided for easier insertion into the alignment slot 303. A hole 309, such as a ½ inch hole is provided in the top leading end of the wedge plate 304 to receive a hair pin cotter 313, which provides a safety stop to prevent inadvertent removal of the wedge plate 304 from the slot 303 during use. A split ring 310, such as a 1 inch diameter split ring is attached to safety chain 311 that attaches the wedge plate 304 to the handle 314 of the yoke plate 301 with a snap hook 312 for easy wedge plate interchange. Pad plates 315 are provided on the bottom jaw of the left and right yoke plates 301 and 302 to provide a flat engagement surface to the bottom of the floor beam. The bottom edge of the wedge plate 304 rests upon the top surface of the girder to which the floor beam is being attached.

Accordingly, a clamping device 300 according to the present invention is a novel device to be used in fit-up and alignment of structural steel shapes. Use of this new clamp makes joint fit-up faster, safer and easier. On a normal construction project, crane rental is the largest hourly expense. By using the clamping device, construction crews can reduce crane usage by 50% or more, thus allowing the crane to service two crews at the same time or increase the efficiency of one crew, saving both time and money. The clamping device keeps fitter's hands away from pinch points and provides stable and reliable support for the beam, making the job safer and easier.

The plate wedge of the clamping device of the present invention simultaneously performs four different functions:

1. Aligns a slot in both yoke plates to lock out rotation of the jaws.
2. Provides outward force to clamp the bracket onto the beam flange.
3. Cantilevers off the end of the beam to provide support from the girder flange.
4. Brings both flanges to a flush position, aligning all bolt holes between the floor beam and girder vertically.

The clamping device is designed primarily to aid in fit-up and alignment of structural steel joints, both welded and bolted. Its use would be advantageous in both field construction and shop fabrication. In addition to being a fit-up bracket, the clamping device can be used for hoisting, lifting and personnel tie-off. Each type of clamping device is designed to fit a specific steel beam shape: wide flange, channel, or angle sections in either a horizontal, vertical or inverted position.

The clamping device can quickly and easily be removed and reattached at a different location. It can also slide along a beam flange and be retightened at a new location.

There are at least four different types of clamping devices:

1. The wide flange version of the clamping device is furnished in two sizes: a smaller version fits beams with flange widths of 4" to 6" and the larger size fits beams with flange widths of 8" to 10".

2. The channel version is a universal clamp that fits the full range of channel sizes.

3. The angle version will fit a range of angles with leg sizes from 1½" up to 4"×½" thick. Various wedge sizes are available to compensate for variations in flange and leg thicknesses.

4. The pipe version—for custom sizes to fit each pipe diameter, used for fit-up not for lifting.

There is no other prior art brackets designed to aid fit-up of structural steel joints. The prior art brackets available are primarily used for lifting, hoisting or attachments of piping and conduit.

An installation crew generally consists of a crane, crane operator, two people sorting and rigging steel on the ground, and two people on the structure doing the fitting and bolt installation. A third person on the structure may be required to signal the crane operator if the placement location is obscured from the crane operator's view. A single floor beam is attached to the crane on the ground then lifted into place by the crane. As the beam approaches its final location, two people on the structure will guide the beam into place, then install and tighten the bolts.

There are several difficulties involved with conventional beam installations. First, with the clip angles in place, the distance between edges of clip angles on opposite ends of the beam is slightly larger than the clear space between the girder webs. This causes the edge of the dip angle to bind on the girder web. This condition requires the beam to be forced into place by multiple blows from a sledgehammer. This process is both time consuming and dangerous. As the dip angles are brought into alignment with the holes in the girder web to a point that daylight can be seen through the holes, a spud wrench is inserted in one hole and maneuvered up and down and side to side to bring the holes into alignment. Then a bolt is inserted into the adjacent hole and the nut installed finger-tight. The procedure is repeated until all the bolts are installed and tightened. During this entire period, the floor beam has been suspended from the crane while the two riggers on the ground stand idle waiting for the crane to return. As such, the crane and crane operator have been on standby the entire time it takes to install and tighten the bolts for the single beam. Depending on the conditions encountered, it can often take from 45 minutes to two hours to install one beam with this prior art procedure.

A special condition exists when two floor beams are framed into a girder on opposite sides using common holes to bolt up. In this case the first beam must be held in place by some means until the second beam is in place and bolted through both sets of clip angles. If bolts were used to hold the first beam in place, this would interfere with installation of the second beam.

Use of the clamping device of the present invention for such beam installations will save time and make it safer and easier to install steel framing. First, the clamping device is attached to each end of the beam while it is on the ground and one clip angle reversed on each end of beams. This arrangement, having the clip angles in reversed position, will eliminate the usual interference caused by the edge of the clip angle. As the beam is lifted into place, the fitters up on the structure can grip the handles of the clamp to guide the beam into position, thus keeping their hands above and away from pinch points.

The beam can then be moved smoothly into place until daylight can be seen through the matching holes. At this point, the load on the crane can be released with clamping devices of the present invention supporting both ends of the beam off the girder. Now, the crane rigging can be released and the crane can return for another load, saving all the crane time it takes to align, install and tighten the bolts. Both the crane operator and ground crew can then concentrate on loading the next beam while the bolts are being installed.

With the beam supported by clamping devices of the present invention, a spud wrench can be inserted into a single hole with alignment made much easier since the holes are already in vertical alignment due to the clamping device. The wedge on the clamp brings the top flanges on both beams to a flush arrangement, thereby aligning all holes in the vertical direction. With the spud wrench in place, a bolt and nut are installed in the adjacent hole on the near side clip angle, then the spud wrench is removed and replaced with a nut and bolt.

At this point, the nuts are removed from the bolts holding the clip angles to the floor beam. The reversed clip angle is removed and placed in the proper orientation and the nuts reinstalled. Then the bolts and nuts on the far side are installed. AH nuts are tightened. The clamping devices remain in place until the crane makes a return trip. Then the clamping devices are removed and attached to the crane rigging where they are returned to the ground to be reused for the next beam to be installed. The clamping devices take the danger element away from this type of connection since the first beam is supported by the wedge plate, instead of bolts or a spud wrench, while the second beam is being installed. After the common bolts are installed and tightened, the clamping device can be removed and the joint is completed both safely and quickly.

Installation and removal of the clamping device requires nothing more than a hammer. In order to install the clamping device to a beam, the following steps are employed.

1. First the right and left jaws of the clamp are separated and placed over the flange of the beam.

2. The center of the clamp is lifted until one side contacts a stop pin. At this position, the two slots on each half of the clamp will be aligned.

3. The tapered end of the wedge plate is then inserted into the slot and moved forward until it contacts the top of the slot. At this point, the clamping device should be centered on the flange and located approximately three inches from the end of the flange.

4. The broad end of the wedge plate is firmly struck several times with a hammer to force the wedge plate between the two jaws to lock the clamp into position. When fully inserted, approximately three inches of the wedge remains behind the jaws of the clamp. The ring proximate the back end of the wedge prevents overdriving of the wedge into the slot.

In the event that a wedge will not tighten, the wedge can be removed and replaced with a larger wedge. The wedges are attached to the clamp with a safety chain and snap hook. This allows for quick and easy replacement of the wedge and prevents unused wedges from being dropped.

To remove the clamping device, the narrow end of the wedge is struck with a hammer to loosen the wedge from the clamp. The wedge can then be removed from the slot, the jaws opened and the clamp removed from the beam flange.

The wedge includes a safety feature that prevents the wedge from being accidently driven out of the slot. A hair-pin cotter is attached about mid-way up the safety chain that can be inserted through the hole proximate the narrow end of the wedge. With the cotter pin in place, the wedge cannot be removed from the slot when the clamp is attached to a beam. Even with the wedge loose in the slot, the clamp cannot be released from the flange of the beam. With the wedge loose but still in the slot, the clamp can be slid along the flange of the beam to a desired location without becoming disengaged from the flange.

The clamping device of the present invention can be made from various material including but not limited to: carbon steel, stainless steel, aluminum, brass, fiberglass, carbon fiber, UHMW, etc. The clamping device can be finished by various methods including but not limited to: painting, galvanizing, anodizing, tumbling, electro-plating, hammering, applying Corten steel, applying Rhino lining, etc.

Figure 9:
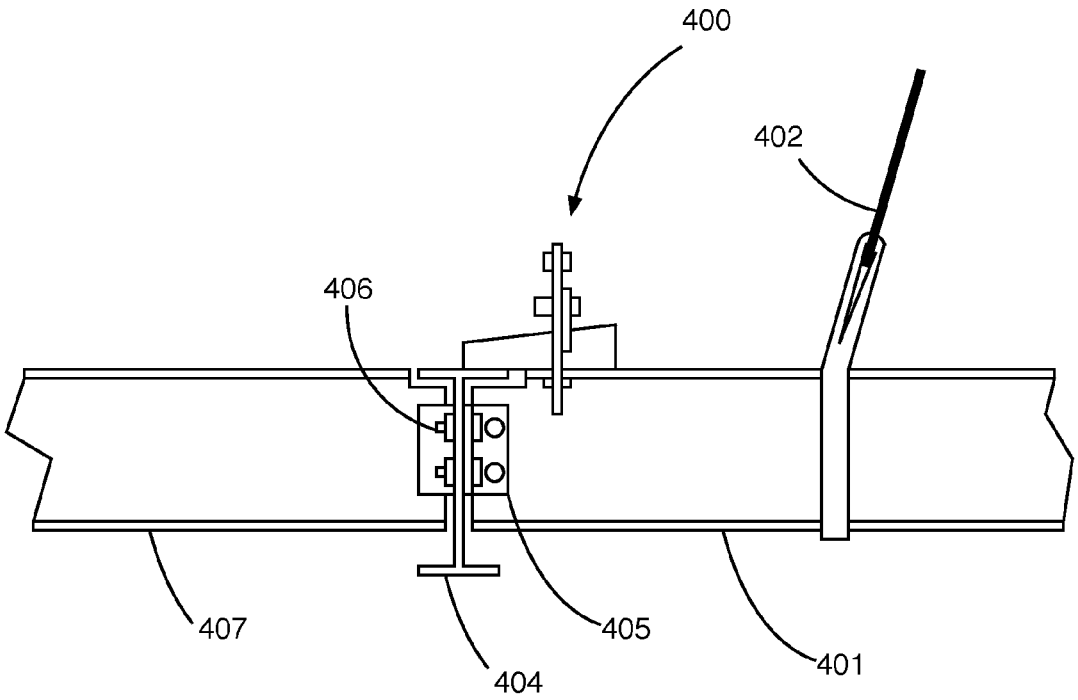
FIG. 9 is a side view of a beam support apparatus according to the principles of the present invention coupled to a beam that is being supported by a support strap of a crane.

FIG. 9 shows a typical beam connection using a clamping device 400 of the present invention. The clamping device 400 is attached to a floor beam 401 being installed. A nylon strap 402 from a crane hook is coupled to the beam 401 for lifting the beam 401 into place until the clamping device 400 is positioned over the existing girder 404 as shown. Clip angle members 405 with bolts 406 are used to couple the floor beam 401 to the girder 404 once the holes between the dips 405 and holes in the girder are aligned. A "suicide" connection beam 407 is also shown for reference. A similar clamp/beam arrangement may be provided on the opposite end (not shown) of the beam 401 to support and align the opposite end of the beam 401 relative to another girder (not shown).

Figure 10:
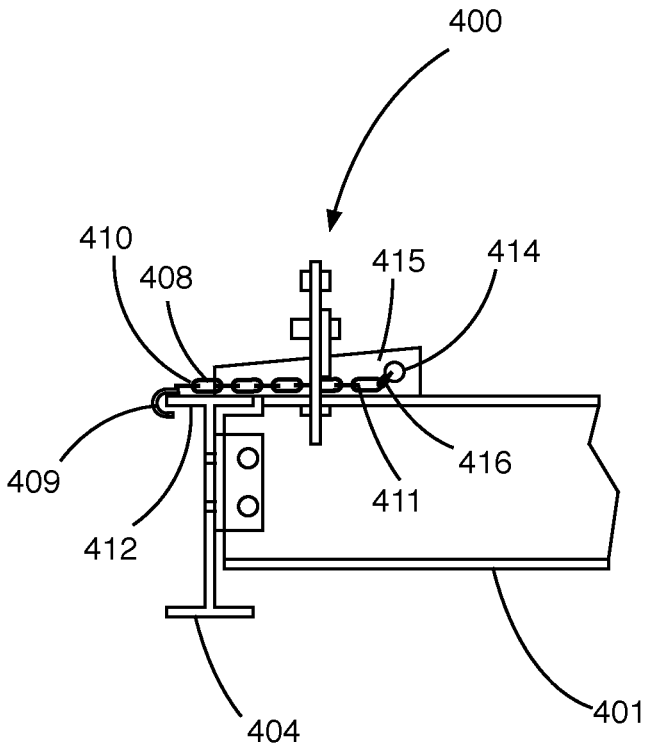
FIG. 10 is a side view of a beam support apparatus according to the principles of the present invention chained to a beam that is being supported by the beam support apparatus.

If there is a chance the two beams may separate during fit-up or when making a "suicide connection," while the floor beam 401 is in place but unbolted, a safety chain 408 can be installed as shown in FIG. 10. The chain 408 has a C-shaped plate 409 on one end configured to hook over the top flange 412 of the girder 404. The other end 411 of the chain 408 passes through a keyhole 414 at the back end of the wedge 415 and a link 416 engages with and locks to the slot at the keyhole 414. If the joist tries to separate, the chain 408 drives the wedge 415 tighter into the clamp 400, thus increasing both the friction force and the clamping force holding the clamp 400 to the flange 416, keeping the joint together. The distal end of the wedge is configured to extend at least about 4 inches over the flange 412 of the girder 404 with the proximal end of the wedge 415 extending about 3 inches from the clamp 400 when fully inserted into the slot of the clamp 400. In this position, the clamp 400 is positioned about 2-3 inches from the end of the flange of the floor beam 401.

Figure 11:
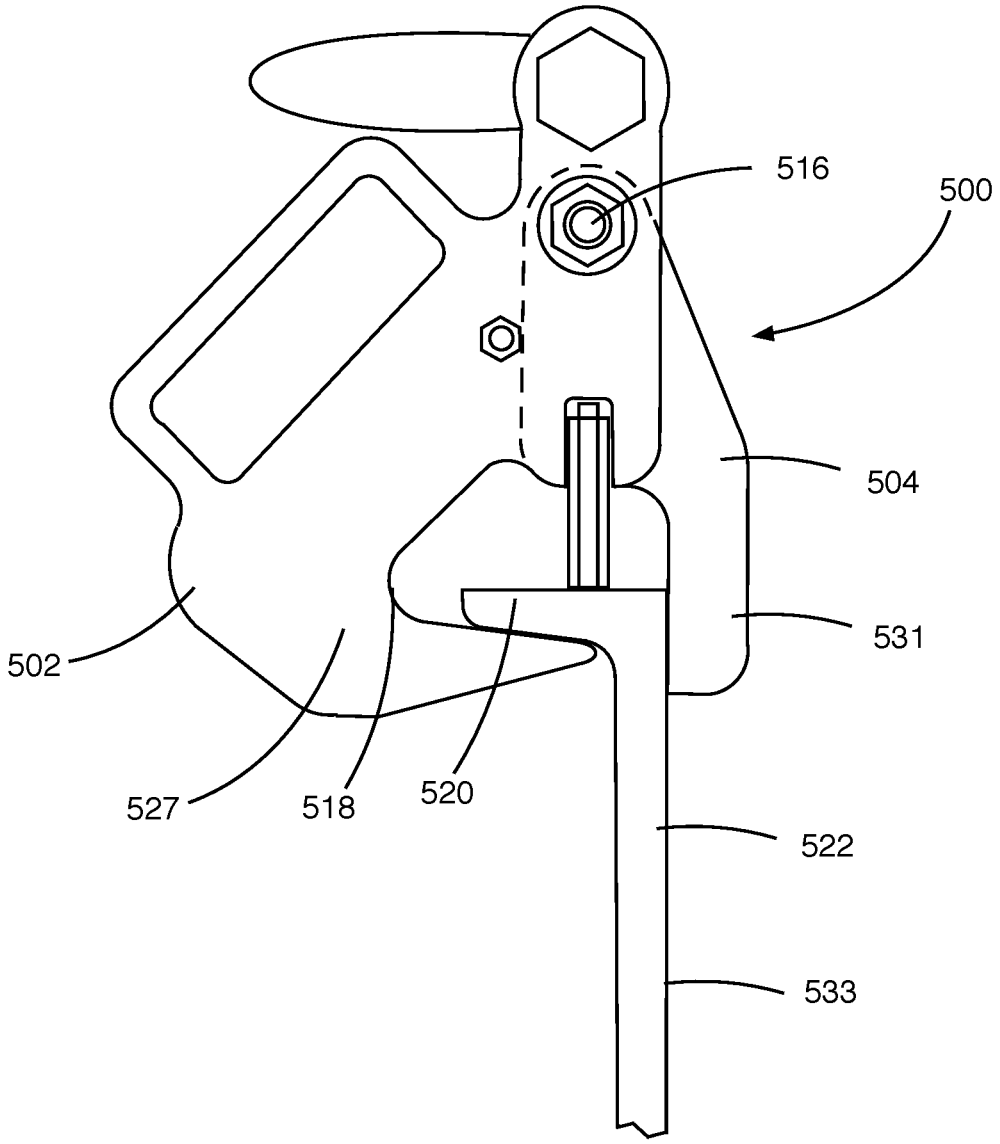
FIG. 11 is a front view of yet another embodiment of an apparatus for supporting a beam in accordance with the principles of the present invention.

As shown in FIG. 11, a clamp assembly 500 of the present invention may be configured to accommodate various types of beams. Similar in configuration of the beam support apparatus 200 shown in FIG. 7. The clamp assembly 500 is comprised of a yoke 502 and a side brace 504. The yoke 502 and brace 504 are pivotally coupled together around bolt 516. The yoke 502 and brace 504 define a beam opening 518 within which one flange 520 of a beam 522 can be positioned. The beam opening 518 defined by the arm portion 527 has a shape to accommodate a flange 520 of the beam 522. When the clamp assembly 500 is in a closed position as shown in FIG. 7, the arm portion 527 resides under the flange 520 of the beam 522 and the arm 531 of the side brace 504 extends along a side surface 533 of the beam 522. As such, side-to-side movement of the beam 522 relative to the apparatus 500 is restricted and the beam 522 cannot be dislodged from apparatus 500.

Figure 12A:
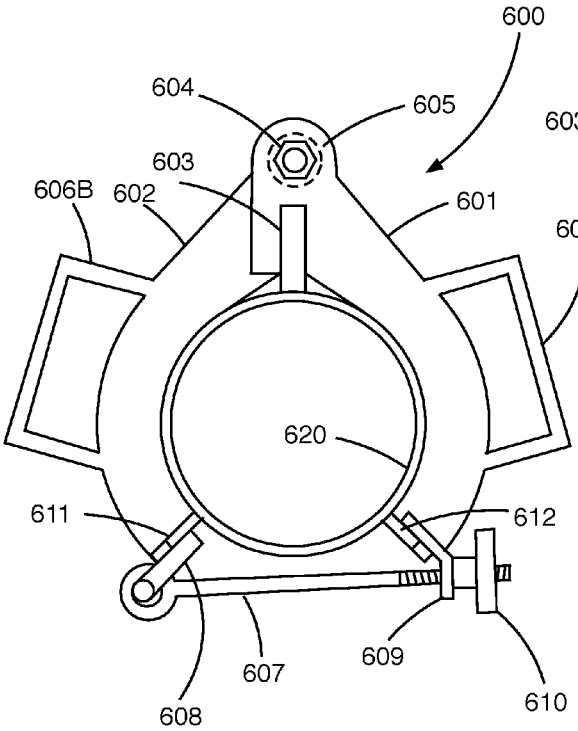
FIGS. 12A and 12B are front and side views of yet another embodiment of a clamping apparatus according to the principles of the present invention configured for aligning two pipes in an end-to-end fashion.
Figure 12B:
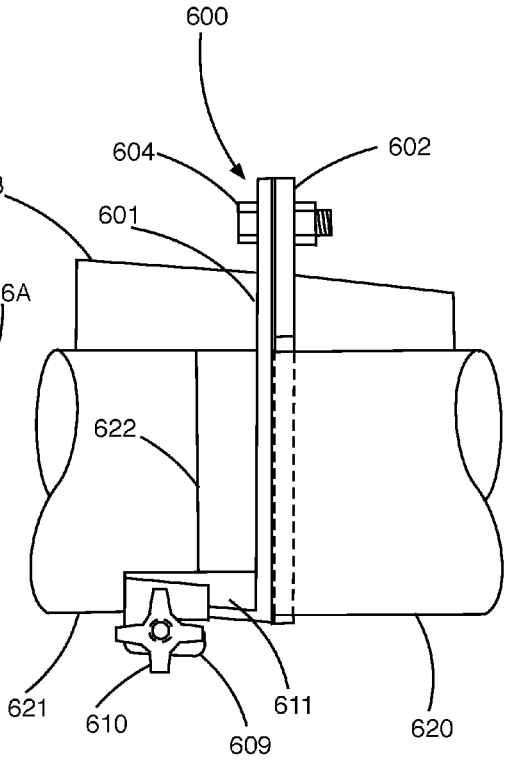

Likewise, as shown in FIGS. 12A and 12B, a clamping apparatus 600 of the present invention may be configured to align two pipes. The clamping apparatus 600 is comprised of a right side yoke plate 601 and a left side yoke plate 602. A wedge plate 603 is provided with a safety chain and snap hook as previously described herein. A hex bolt pivot pin 604 pivotally couples the yoke plates 601 and 602 together. A flat washer 605 is provided between the yoke plates 601 and 602. Handles 606A and 606B are integrally formed with respective yoke plates 601 and 602. An eye bolt 607, which may be a ⅜ inch outer diameter, 8 inch long forged eye bolt with a threaded end, is coupled between the two yoke plates 601 and 602. A U-shaped rod 608, which may have ½ inch outer diameter is welded to the yoke plate 602. Similarly, a bent plate 609 having a slot for selectively receiving the threaded end of the eyebolt 607 is welded to yoke plate 601. A four arm knob 610, which may be cast in steel and have internal threads is threaded onto the eyebolt 607. The eyebolt 607 extends between the U-shaped rod and the bent plate 609 and is secured with the knob 610 upon tightening, which draws the two yokes 601 and 602 together in order to clamp the yokes 601 and 602 to the pipes 620 and 621 in order to hold the two pipe sections 620 and 621 in an abutting fashion while they are welded together about the weld seam 622. Clamp arms 611 and 612 are provided on the respective yoke plates 601 and 602 to support both pipe sections 620 and 621. Thus, the apparatus of the present invention can be modified in any number of ways in light the various embodiments of the present disclosure, including combinations thereof, to support coupling heavy objects in an abutting fashion by modifying the configuration of the inside of the yoke plates to accommodate the particular objects.

There is thus disclosed an improved clamping apparatus and methods of using the improved clamping apparatus. In the foregoing specification, the present invention has been described with reference to specific exemplary embodiments. Various modifications and changes may be made, however, without departing from the spirit and scope of the present invention as set forth in the claims, including combinations of elements of the various illustrated embodiments. The specification and figures are illustrative, not restrictive, and modifications are intended to be included within the scope of the present invention. Accordingly, the scope of the present invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The phrase "consisting essentially of" as may be used herein is intended to cover additional elements or functions that do not materially affect the basic and novel characteristics of the claimed invention. Thus, "consisting essentially of" is intended to encompass not only those components specifically listed, but also separate or additional components that do not materially alter the specifically recited functions or elements.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. A clamping apparatus, comprising:

a first yoke having a first support arm and defining a first wedge slot transversely extending across the first yoke above the first support arm;

a second yoke pivotally coupled to the first yoke and having a second support arm inwardly extending toward and laterally spaced from the first support arm and defining a second wedge slot transversely extending across the second yoke above the second support arm, the first and second wedge slots being substantially aligned when the first and second yokes are in a closed position;

a wedge configured for insertion within the first and second wedge slots so as to extend transversely through the first and second yokes when the first and second wedge slots are substantially aligned to hold a structure between the wedge and the first and second support arms of the first and second yokes, a proximal end of the wedge including a keyhole configured for receiving a link of a chain; and a chain having a first end configured for coupling to an outer flange of a beam and a first portion for passing through the key hole in order to secure a link of the chain to the keyhole to thereby hold the wedge to the beam.

2. The clamping apparatus of claim 1, wherein the first yoke comprises a first handle portion laterally extending from the first yoke.

3. The clamping apparatus of claim 2, wherein the second yoke comprises a second handle portion laterally extending from the second yoke.

4. The clamping apparatus of claim 1, wherein the first support arm includes a first support plate attached to a distal end thereof for supporting a first side of the flange of the beam positioned thereon and the second support arm includes a second support plate attached to a distal end thereof for supporting a second side of the flange of the beam positioned thereon.

5. The clamping apparatus of claim 1, wherein the wedge is tapered from a first end to a second end such that when the wedge is inserted through the first and second wedge slots and over the structure the wedge can only be partially inserted through the first and second wedge slots.

6. The clamping apparatus of claim 1, wherein the chain is coupled between one of the first and second yokes and a distal end of the wedge when the wedge is inserted through the first and second slots to prevent removal of the wedge from the first and second yokes.

7. The clamping apparatus of claim 1, further comprising a hoist structure coupled to a top portion of the first yoke for lifting the clamping apparatus with a crane.

8. The clamping apparatus of claim 1, wherein the first and second yokes are pivotally coupled together with a bolt passing through the first and second yokes above the first and second slots when the first and second slots are in substantial alignment.

9. The clamping apparatus of claim 1, further comprising a stop coupled to the first yoke that prevents the second yoke from pivoting toward to the first yoke beyond the stop.

10. A beam support apparatus, comprising:

a first yoke plate having a first pivot portion defining a pivot location, a first wedge slot formed in the first yoke plate and extending transversely to the first yoke plate below the first pivot, a first arm portion depending from the first pivot portion;

a second yoke plate having a second pivot portion pivotally coupled to the first pivot portion to pivot relative to the first yoke plate at the pivot location, a second wedge slot formed in the second yoke plate and extending transversely to the second yoke plate below the pivot location, a second arm portion depending from the second pivot portion, the first and second arm portions inwardly extending toward one another and forming a beam receiving opening therein between; and a wedge configured for insertion within the first and second wedge slots when the first and second yoke plates are pivoted relative to each other until the first and second wedge slots are substantially aligned, the wedge configured to rest upon a top surface of and be aligned substantially parallel to a long axis of a beam at least partially positioned within the beam receiving opening and to extend over an adjacent beam to which the beam is to be attached to thereby support the beam to the adjacent beam.

11. The beam support apparatus of claim 10, wherein the first yoke plate comprises a first handle portion laterally extending from and integrally formed with the first yoke plate and away from the beam receiving opening.

12. The beam support apparatus of claim 11, wherein the second yoke plate comprises a second handle portion laterally extending from and integrally formed the second yoke plate and away from the beam receiving opening.

13. The beam support apparatus of claim 10, further comprising a first support pad attached to the first arm portion for supporting a first side of a flange of a beam positioned thereon and a second support pad attached to the second arm portion for supporting a second side of a flange of the beam positioned thereon.

14. The beam support apparatus of claim 10, wherein the wedge is tapered from a first end to a second end such that when the wedge is inserted through the first and second wedge slots and over the beam the wedge can only be partially inserted through the first and second wedge slots.

15. The beam support apparatus of claim 10, wherein a proximal end of the wedge includes a keyhole configured for receiving a link of a chain and further comprising a chain having a first end configured for coupling to an outer flange of the beam and a second end for passing through the key hole in order to secure a link of the chain to the keyhole to thereby hold the wedge to a second beam.

16. The beam support apparatus of claim 10, further comprising a chain coupled between one of the first and second yoke plates and a distal end of the wedge when the wedge is inserted through the first and second slots to prevent removal of the wedge from the first and second yoke plates.

17. The beam support apparatus of claim 10, further comprising a hoist structure coupled to a top portion of the first yoke plate for lifting the beam support apparatus with a crane.

18. The beam support apparatus of claim 10, wherein the first and second yoke plates are pivotally coupled together with a bolt passing through the first and second yoke plates above the first and second slots when the first and second slots are in substantial alignment.

19. The beam support apparatus of claim 10, further comprising a stop coupled to the first yoke plate that prevents the second yoke plate from over pivoting relative to the first yoke plate.

20. A clamping apparatus, comprising:

a first yoke having a first support arm and defining a first wedge slot transversely extending across the first yoke above the first support arm;

a second yoke pivotally coupled to the first yoke and having a second support arm inwardly extending toward and laterally spaced from the first support arm and defining a second wedge slot transversely extending across the second yoke above the second support arm, the first and second wedge slots being substantially aligned when the first and second yokes are in a closed position;

a wedge configured for insertion within the first and second wedge slots so as to extend transversely through the first and second yokes when the first and second wedge slots are substantially aligned to hold a structure between the wedge and the first and second support arms of the first and second yokes; and a stop coupled to the first yoke that prevents the second yoke from pivoting toward to the first yoke beyond the stop.

* * * * *